United States Patent [19]

Dinnissen

[11] Patent Number: 4,544,147

[45] Date of Patent: Oct. 1, 1985

[54] APPARATUS FOR FEEDING SHEETS ONE BY ONE

[75] Inventor: Johannes H. A. Dinnissen, Venlo, Netherlands

[73] Assignee: Océ-Nederland B.V., Venlo, Netherlands

[21] Appl. No.: 495,672

[22] Filed: May 18, 1983

[30] Foreign Application Priority Data

May 26, 1982 [NL] Netherlands ..... 8202141

[51] Int. Cl.[3] ..... B65H 3/52

[52] U.S. Cl. ..... 271/35; 271/122

[58] Field of Search ..... 271/35, 34, 122, 121, 271/124, 125, 165, 166, 160, 37, 38

[56] References Cited

U.S. PATENT DOCUMENTS

| | | | |
|---|---|---|---|
| 1,506,423 | 8/1924 | Gray | 271/121 |
| 3,239,213 | 3/1966 | Griswold | 271/35 |
| 3,870,294 | 3/1975 | Donner | 271/35 |
| 4,059,262 | 11/1977 | Fujimoto | 271/35 |
| 4,114,870 | 9/1978 | Di Blasio | 271/35 |
| 4,284,269 | 8/1981 | Ignatjev | 271/122 |

FOREIGN PATENT DOCUMENTS

| | | | |
|---|---|---|---|
| 0063833 | 11/1982 | European Pat. Off. | 271/35 |
| 2206259 | 6/1974 | France . | |
| 137243 | 8/1982 | Japan | 271/122 |
| 1523916 | 9/1978 | United Kingdom . | |

*Primary Examiner*—Bruce H. Stoner, Jr.
*Assistant Examiner*—Alvin Oberley
*Attorney, Agent, or Firm*—Albert C. Johnston

[57] ABSTRACT

An apparatus for feeding sheets one by one from a group of at least partially overlapping sheets, in which a conveyor belt in contact with the lowermost sheet is driven to feed that sheet in the desired transport direction while a sheet separating roller forming a nip with the belt is driven so as to move the surface of the roller through the nip in the opposite direction, thus holding back of the nip sheets lying on the lowermost sheet, is provided with a displaceable member, for example a flat end portion of a leaf spring wound into a spiral, which has a smooth underside to receive under this member and press on the sheets approaching the nip and has a forward end edge slidably engaged with the surface of the roller immediately adjacent to the location where the sheets contact the roller. The displaceable member prevents the sheets from curling up or buckling in the vicinity of the roller, irrespective of the number of sheets and irrespective of variations of the position of the separating roller.

9 Claims, 2 Drawing Figures

APPARATUS FOR FEEDING SHEETS ONE BY ONE

Figure 1:
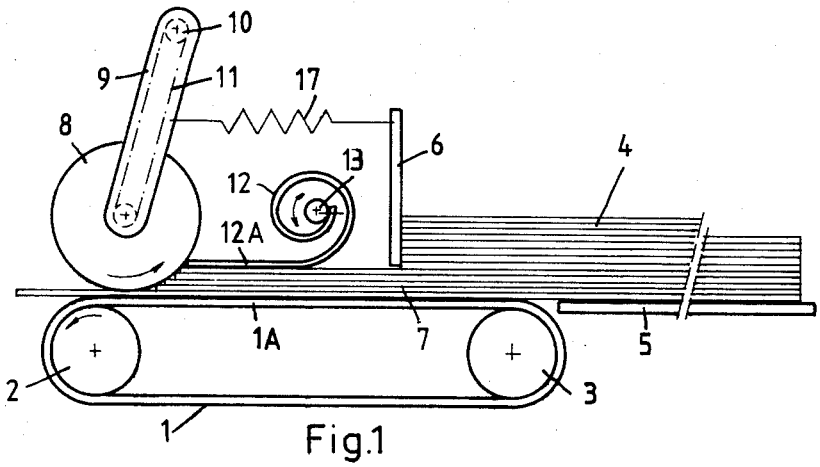

This invention relates to an apparatus for feeding sheets one by one from a group of at least partially overlapping sheets, so as to make sure that only one sheet at a time is delivered into a processing path such, for example, as a sheet transport path of a copying machine.

German Offenlegungsschrift No. 2 334 551 discloses an apparatus for this purpose which comprises a drivable conveyor system for advancing at least the outermost sheet from a stack of sheets and a separator roller that forms a nip with a member of the conveyor system and is driven in direction opposite to the direction of the advance of the sheets in order to retain or push backward the leading edges of sheets fed to the roller with the outermost sheet.

In that known apparatus, a plate is provided between the stack and the sheet separating roller, with part of the plate extending at some distance from and approximately concentric to the surface of the roller. The plate insures that only a limited number of sheets can be fed simultaneously from the stack toward the roller. This plate device, however, is disadvantageous in that the leading edges of sheets coming into contact with the separating roller may curl up and then reach the space between the roller and the plate, thus damaging the sheets. The sheets may also be damaged by being buckled in the space between the stack and the plate as a result of the counteracting forces exerted on the sheets by the roller and the conveyor member.

These disadvantages will occur particularly when thin and/or limp sheets are processed, or sheets which already exhibit a tendency to curl or buckle, for example, because of having been folded previously.

The object of the present invention is to provide an apparatus for feeding sheets one by one from a group of at least partially overlapping sheets advanced by a conveyor, whereby the above-noted disadvantages can be overcome. Thus, with this apparatus the position of the sheets advanced by a conveyor to a sheet separating roller is controlled so that only one sheet at a time will be fed through the nip of the roller and the sheets will neither be curled up at the roller nor buckled as they are advanced to the nip.

According to the present invention, in an apparatus including conveyor means for engaging with and drivable to advance at least the outermost sheet of a group of at least partially overlapping sheets, a sheet separating roller positioned adjacent to the conveyor means so as to form a nip with it and means for driving the roller to move its surface through the nip in a direction opposite to the direction of advance of sheets by the conveyor means, a sheet position controlling means is provided which comprises a displaceable member that is disposed behind the nip, is continually pressed toward the conveyor means, has an underside that bears under pressure slidably against a leading portion of a sheet or sheets in the vicinity of the nip, and has a forward end edge of the member disposed in slidable contact with the surface of the separating roller behind the nip. As a result of this position controlling means, the sheets approaching the nip are kept completely flat over an appreciable leading portion thereof until they reach the roller surface, so that they are prevented from curling and buckling notwithstanding the forces exerted on their leading edges by the counter-moving surface of the roller.

As another feature of this arrangement, the displaceable member can remain in contact with the surface of the separating roller even upon variations of the location of the roller relative to the conveyor means at the nip, which variations may occur, for example, as a result of wear of the roller surface; and the displaceable member can also adapt automatically to the number of sheets present near the nip.

Figure 2:
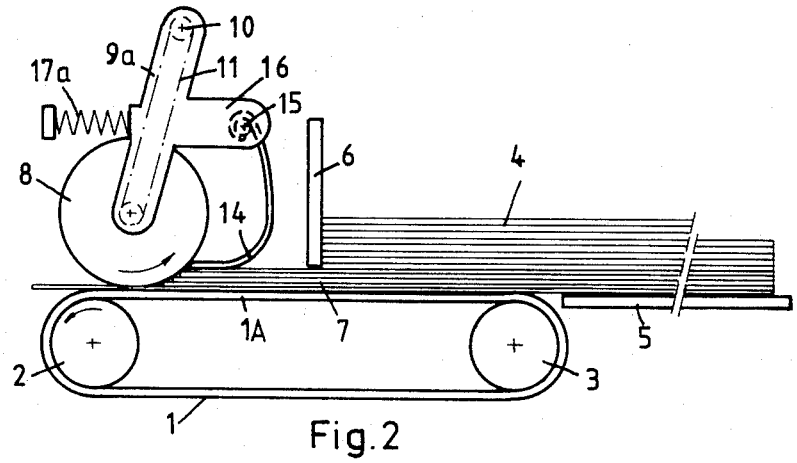

Other features and advantages of the invention will be apparent from the following description in which reference is made to the accompanying drawings. In the drawings:

FIG. 1 is a schematic side elevational view of a preferred embodiment of the invention, and FIG. 2 is a similar view of an alternative embodiment.

The apparatus as shown schematically in FIGS. 1 and 2 comprises an endless conveyor belt 1 running about a driving roller 2 and a freely rotatable roller 3. Roller 2 can be driven in the direction indicated by the arrow. A stack 4 of sheets is supported partially on the upper flight 1A of the conveyor belt and partially on a fixed plate 5. The belt flight 1A extends away from the stack 4 in the direction of conveyance of the sheet. An abutment strip 6 disposed above and across the belt flight 1A limits the position of sheets at the front side of the stack and forms a slit-like passage 7 through which a number of at least partially overlapping sheets can pass simultaneously between the lower edge of the abutment strip 6 and the conveyor belt.

A sheet separating roller 8 is positioned adjacent to the belt flight 1A so as to form with the belt a nip located in the path of movement of the sheets, though at some distance from the passage 7. The shaft of the roller 8 is mounted in bearings in at least one arm 9 which is swingable about the axis of a drivable shaft 10. The roller shaft is connected via a belt 11 with the shaft 10 so that by rotation of the shaft 10 the roller 8 can be rotated to move its surface through the nip in the direction opposite to the direction of movement belt flight 1A.

By appropriate choice of materials the conveyor belt 1 and the surface of the sheet separating roller 8 are readily made so that the friction between a sheet and the conveyor belt is greater than the friction between a sheet and the roller surface and the friction between the roller surface and a sheet is greater than the friction between two sheets. Thus, while the lowermost sheet of the group being advanced to the roller is being delivered by the belt through the nip between the roller and the belt, each other sheet of the group or pile will be retained or pushed backward by the roller surface moving counter to the belt at the nip.

In the apparatus according to FIG. 1, a position controlling means in the form of a smooth leaf spring 12 wound into a spiral is disposed in the space between the passage 7 and the sheet separating roller 8. The leaf spring 12 has a substantially flat, displaceable end portion 12A which is pressed yieldably toward the conveyor belt 1 or against a leading portion, in the vicinity of roller 8, of the sheet or sheets lying on the belt. The flat end portion 12A extends to a free end thereof which is held resiliently in slidable contact with the surface of the separator roller.

When the roller 2 is driven, the conveyor belt 1 feeds sheets from the stack 4 via the passage 7. The number of sheets entrained is restricted by the height of the passage 7. The sheets can readily slide along the smooth underside of the leaf spring 12 and come into contact with the separator roller 8. The underside of the spring 12 along and leading into its displaceable end portion 12A is made smooth so as to keep the friction of that portion relative to the sheets as low as practicable, e.g., by making the surface of the spring therealong of well-polished metal or of a plastic having a low coefficient of friction, such as e.g., polytetrafluoroethylene.

The sheet separating roller 8 exerts a retaining or backward pushing frictional force on the leading edges of the entrained sheets and on the free end of the leaf spring 12, while the displaceable end portion 12A presses down flatly on these sheets. Only the bottom sheet is fed through the nip, as the conveyor belt 1 exerts a frictional force on the sheet far greater than the frictional force of the roller surface on the leading edge of the sheet.

The flat end portion 12A of the leaf spring rests on the top one of the entrained sheets. The leading edges of these sheets bear against the roller 8 in such a way that, while abutting the roller, these sheets rest on one another with their edges offset, somewhat like roof tiles. The displaceable flat end portion 12A of the leaf spring prevents the sheets from buckling in the space between the passage 7 and the roller 8, and since the free end of the displaceable portion 12A is held resiliently in sliding contact with the surface of roller 8 rotating thereagainst, the leading edges of the sheets are prevented from curling up behind the roller.

Depending upon the number of sheets coming between the conveyor belt and the leaf spring, and the thickness thereof, the leaf spring will be displaced upward to a varying degree with consequent variation of the location of its point of contact with the surface of the roller 8. The accompanying horizontal movement of the free end and flat portion 12A of the spring is accommodated by the spiral portion of the leaf spring 12. As another result of the horizontal mobility of the flat end portion of the leaf spring, its free end will be kept in contact with the roller surface when a change occurs in the location of the nip between the roller 8 and the belt flight 1A. Such a change will occur, for example, upon a decrease of the diameter of the roller 8 due to wear, when the roller position will be shifted in the direction toward the leaf spring by the action of a spring 17 that pulls on the swingable arm 9 of the roller.

The force with which the flat end portion of the leaf spring presses on the conveyor belt or on the sheets thereon can be adjusted by turning the pivot element 13 to which the fixed end of the leaf spring is secured. Such an adjustment can also ensure that when sheets are not present the free end of the leaf spring will not be pulled past the nip of the roller by friction of the belt.

In another embodiment of the invention, as illustrated in FIG. 2, the position controlling means comprises a leaf spring 14 having a displaceable flat end portion thereof held in contact with the conveyor belt or the sheets thereon, and having its free end held in slidable contact with the surface of the sheet separating roller 8, in substantially the same way as described hereinbefore with reference to FIG. 1. In this embodiment, however, the other end of the leaf spring 14 is secured to a turnable element 15 which is fixed pivotally to a projection 16 of a swingable arm **9*a* on which the roller 8 is mounted. A compression spring 17*a* presses arm 9*a* toward belt flight 1A**.

It results in the embodiment of FIG. 2, since the leaf spring 14 is fixed to the arm **9*a*, that the leaf spring will follow any movement of the arm 9*a* and hence any displacement of the sheet separating roller 8. Consequently the leaf spring to be used in this embodiment can have less curvature than the leaf spring 12 of the apparatus according to FIG. 1, although it still is to keep its displaceable flat end portion sufficiently mobile relative to the point where the spring 14 is fixed to the turnable element 15 so that the free end of the spring can continue to be in contact with a part of the surface of the roller 8** behind the nip in the presence of the maximum number of sheets that will be fed to the separating roller.

It will be apparent that a displaceable member continually pressed toward the conveyor means and contacting a sheet separating roller so as to serve functions of the spring pressed end portion of element 12 or element 14 may also be provided by devices of other forms. For instance, a suitably formed block may be provided for pressing by its own weight on the sheets in the space leading to the sheet separating roller, this block being provided with a smooth flat underside having a tapering entry portion to admit sheets beneath the block and with a forward end edge that can stay in sliding contact with the roller surface.

In still another form of a device embodying the invention, the displaceable member may also extend laterally to either side of the nip of the sheet separating means so as to hold a sheet or sheets pressed flat on the conveyor belt in these regions as well.

I claim:

1. In an apparatus for feeding sheets one by one, including conveyor means for engaging with and drivable to advance at least the outermost sheet of a group of at least partially overlapping sheets, sheet separating means comprising a roller positioned adjacent to said conveyor means so as to form therewith a nip for passing the outermost sheet therebetween and means for driving said roller to move its surface through said nip in a direction opposite to the direction of advance of sheets by the conveyor means, means for controlling the position of the sheets advanced toward said roller by said conveyor means, comprising a displaceable member disposed behind said nip and continually pressed toward said conveyor means and having an underside that admits under said member and presses slidably against a leading portion of a sheet or sheets in the vicinity of said nip, said member being displaceable relative to said roller in said direction of advance of sheets and in the direction perpendicular thereto, and said member having a forward end edge thereof continually disposed in slidable contact with said roller surface behind said nip.

2. Apparatus according to claim 1, the friction between a said sheet and said roller surface being less than the friction between a sheet and said conveyor means and greater than the friction between two of the sheets, said underside of said displaceable member being smooth so as to exert relatively little friction on said sheet or sheets yet by pressing thereon enhancing the friction between said outermost sheet and said conveyor means.

3. Apparatus according to claim 1 or 2, said position controlling means comprising spring means continually pressing said displaceable member yieldably toward said conveyor means and against said roller surface.

4. Apparatus according to claim 1 or 2, said underside of said displaceable member being substantially flat and extending toward said nip to a said forward end edge of said member in contact with said roller surface.

5. Apparatus according to claim 4, said end edge having a thickness of less than 0.2 mm.

6. Apparatus according to claim 1 or 2, said position controlling means comprising a leaf spring one end portion of which constitutes said displaceable member and the other end of which is secured to a support means that is adjustable to stress said spring so that said one end portion is pressed yieldably toward said conveyor means with its forward edge bearing against said roller surface.

7. Apparatus according to claim 6, said adjustable support means comprising a turnable element having said other end of said spring secured thereto, said spring being wound in a spiral about said turnable element and extending from the spiral into said one end portion.

8. Apparatus according to claim 7 and further including arm means swingably supporting said roller so that it is biased yieldably toward engagement of its surface with said conveyor means, said turnable element being mounted on a part of said arm means.

9. In an apparatus for feeding sheets one by one, including a conveyor belt having a flight thereof disposed to engage with and drivable to advance at least the lowermost sheet of a group of sheets that at least partially overlap, a sheet separating roller yieldably biased toward said belt flight so as to form therewith a nip for passing the lowermost sheet therebetween and means for driving said roller to move its surface through said nip in a direction opposite to the direction of movement of said belt flight, means for controlling the position of the sheets advanced toward said roller on said belt flight comprising a leaf spring having a substantially flat end portion disposed to press slidably against a leading portion of said sheets in the vicinity of said nip, said end portion extending to a thin end edge thereof slidably contacting said roller surface behind said nip, said spring being secured at its other end to a turnable support and being wound about said support in a spiral from which it extends into said flat end portion, said support being turnable to stress said spring so that it continually presses said flat end portion yieldably toward said belt flight and against said roller surface with force sufficient to prevent both buckling of said sheets and curling of their leading edges in the vicinity of said roller.

* * * * *